US010760201B2

(12) United States Patent
Leibman et al.

(10) Patent No.: US 10,760,201 B2
(45) Date of Patent: Sep. 1, 2020

(54) WASHING MACHINE APPLIANCE WITH A RETRACTABLE HOSE

(71) Applicant: Haier US Appliance Solutions, Inc., Wilmington, DE (US)

(72) Inventors: Alexander B. Leibman, Prospect, KY (US); Manidhar V V S Yandamuri, Hyderabad (IN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 121 days.

(21) Appl. No.: 15/915,140

(22) Filed: Mar. 8, 2018

(65) Prior Publication Data

US 2019/0276975 A1 Sep. 12, 2019

(51) Int. Cl.
*D06F 39/08* (2006.01)

(52) U.S. Cl.
CPC ..... *D06F 39/083* (2013.01)

(58) Field of Classification Search
CPC ..... D06F 39/083; D06F 29/00; D06F 39/12; D06F 39/088; D06F 19/00; D06F 43/002; D06F 29/005
USPC .... 68/205 R, 13 R, 196, 3 SS, 235 R, 12.19, 68/14, 207; 239/526, 281, 195
See application file for complete search history.

(56) References Cited

U.S. PATENT DOCUMENTS 1,675,140 A * 6/1928 Schenderlein ..... B65H 75/38 242/376.1
3,490,254 A * 1/1970 Mason ..... D06F 13/00 68/14
6,948,527 B2 * 9/2005 Ragner ..... A47L 9/24 138/118
7,814,768 B2 * 10/2010 Vecchi ..... D06F 19/00 134/1
8,322,169 B2 * 12/2012 Kendall ..... D06F 29/00 68/13 R
8,459,067 B2 6/2013 Kendall et al.
8,549,887 B2 * 10/2013 Reid ..... B08B 3/12 68/3 R
8,800,325 B2 * 8/2014 Chung ..... D06F 39/081 68/17 R
9,611,578 B2 4/2017 Underly et al.
9,822,480 B2 * 11/2017 Fung ..... D06F 87/00
2002/0134117 A1 * 9/2002 Arai ..... D06F 19/00 68/3 SS
2005/0056059 A1 * 3/2005 Usherovich ..... D06F 39/14 68/12.02
2006/0156763 A1 * 7/2006 Vecchi ..... D06F 19/00 68/3 SS (Continued)

*Primary Examiner* — David G Cormier
*Assistant Examiner* — Thomas Bucci
(74) *Attorney, Agent, or Firm* — Dority & Manning, P.A.

(57) ABSTRACT

A washing machine appliance includes a cabinet and a wash tub mounted within the cabinet. The washing machine appliance also includes a spray hose assembly fluidly connected to a wash fluid source and configured for selectively providing a flow of wash fluid in a desired direction and location. The spray hose assembly includes a retractable hose mounted within the cabinet and a spray head attached to the retractable hose. The retractable hose of the spray hose assembly may be retractable by one or both of a coiled section of the retractable hose or a torsion spring configured to provide a return force to the retractable hose.

14 Claims, 7 Drawing Sheets

(56) References Cited

U.S. PATENT DOCUMENTS

| | | | | |
|---|---|---|---|---|
| 2008/0209774 | A1* | 9/2008 | Robin | D06F 75/20 38/77.6 |
| 2016/0102425 | A1* | 4/2016 | Scheckelhoff | D06F 39/00 68/13 R |
| 2016/0138207 | A1 | 5/2016 | Del Pos et al. | |
| 2018/0142391 | A1* | 5/2018 | Hombroek | D06F 3/04 |
| 2018/0340287 | A1* | 11/2018 | Carpenter | D06F 17/10 |

* cited by examiner

WASHING MACHINE APPLIANCE WITH A RETRACTABLE HOSE

FIELD OF THE INVENTION

The present subject matter relates generally to washing machine appliances, and more particularly to accessories for washing machine appliances.

BACKGROUND OF THE INVENTION

Washing machine appliances generally include a tub for containing water or wash fluid, e.g., water and detergent, bleach, and/or other wash additives. A basket is rotatably mounted within the tub and defines a wash chamber for receipt of articles for washing. During normal operation of such washing machine appliances, the wash fluid is directed into the tub and onto articles within the wash chamber of the basket. The basket or an agitation element can rotate at various speeds to agitate articles within the wash chamber, to wring wash fluid from articles within the wash chamber, etc.

During operation of certain washing machine appliances, a volume of wash fluid is directed into the tub in order to wash and/or rinse articles within the wash chamber. One or more additives may be added to the wash fluid to enhance the cleaning or other properties of the wash fluid.

The volume of water or wash fluid needed may vary depending upon a variety of factors. For example, large loads can require a large volume of water relative to small loads that can require a small volume of water. A user may wish to have additional wash fluid dispensed in order to perform a specific task, e.g., prewash an article of clothing or add additional fluid to accommodate an extra-large load. A user may wish to direct the flow of wash fluid onto a particular garment or within a specific region of the wash tub, e.g., to perform a pretreating operation, to saturate a particular article of clothing, or to accommodate an extra-large load. The ability to adjust the amount of water or wash fluid and its dispensing location is a commercially desirable feature and increases the user's positive perception of the wash process generally.

Accordingly, a washing machine appliance that provides a user with more control over the water or wash fluid fill amount is desirable. In particular, a washing machine appliance with features for controlling and directing the wash fluid fill would be particularly beneficial.

BRIEF DESCRIPTION OF THE INVENTION

The present subject matter provides a washing machine appliance including a cabinet with a wash tub within the cabinet and a spray hose assembly. The spray hose assembly includes a spray head connected to the cabinet by a retractable hose. Additional aspects and advantages of the invention will be set forth in part in the following description, or may be apparent from the description, or may be learned through practice of the invention.

In one embodiment, a washing machine appliance defining a vertical direction, a lateral direction, and a transverse direction is provided. The vertical direction, the lateral direction and the transverse direction are mutually perpendicular. The washing machine appliance includes a cabinet extending between a top and a bottom along the vertical direction. A wash tub is mounted within the cabinet and configured for containing fluid during operation of the washing machine appliance. The washing machine appliance also includes a spray hose assembly fluidly connected to a wash fluid source and configured for selectively providing a flow of wash fluid in a desired direction and location. The spray hose assembly includes a retractable hose comprising a coiled section mounted within the cabinet and a spray head attached to the retractable hose.

In another embodiment, a washing machine appliance is provided. The washing machine appliance includes a cabinet and a wash tub mounted within the cabinet. The wash tub is configured for containing fluid during operation of the washing machine appliance. An aperture is defined in the cabinet. The wash tub is aligned with the aperture such that the aperture provides access to the wash tub. The washing machine appliance also includes a door mounted to the cabinet. The door is adjustable between an open position permitting access to the wash tub via the aperture and a closed position wherein the door encloses the aperture. The washing machine appliance also includes a spray hose assembly fluidly connected to a wash fluid source and configured for selectively providing a flow of wash fluid in a desired direction and location. The spray hose assembly includes a retractable hose partially disposed within the cabinet, a torsion spring connected to the retractable hose, the torsion spring configured to provide an angular return force to the retractable hose biasing the retractable hose into the cabinet, and a spray head attached to the retractable hose. The retractable hose extends through an opening in the cabinet proximate the aperture.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
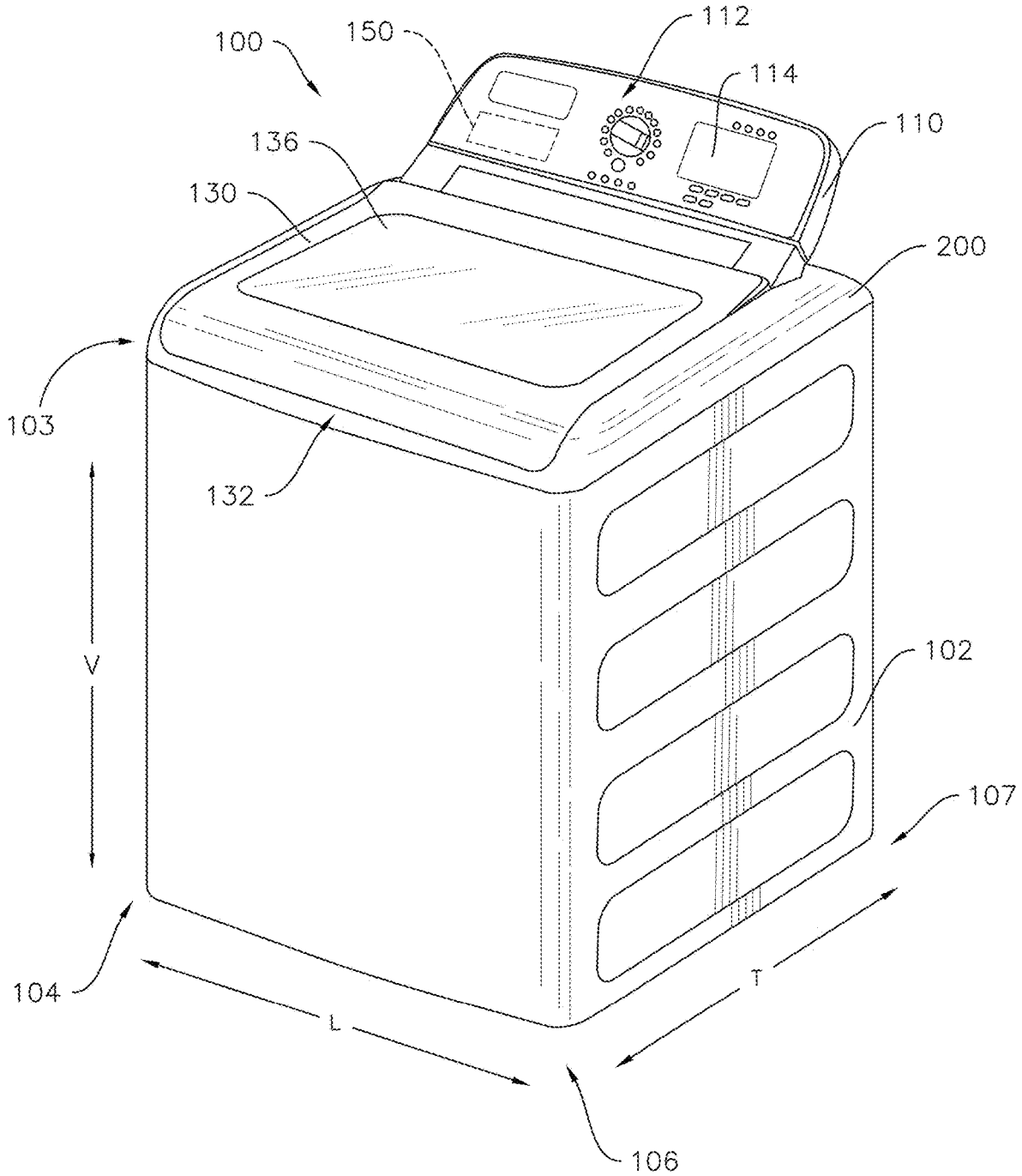
FIG. 1 provides a perspective view of an exemplary washing machine appliance that may incorporate various embodiments of the present subject matter with a door or lid of the washing machine appliance shown in a closed position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
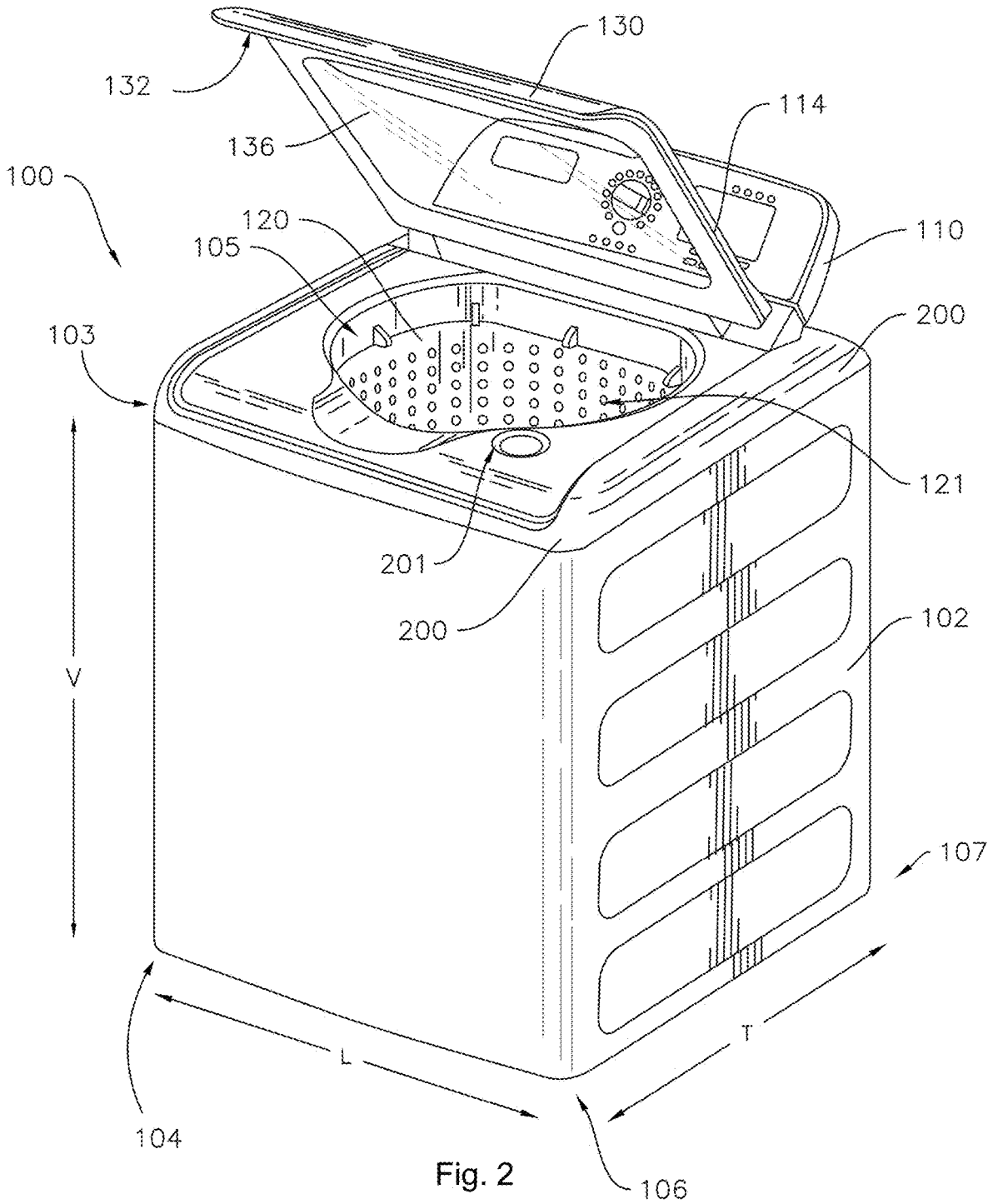
FIG. 2 provides a perspective view of the exemplary washing machine appliance of FIG. 1 with the door of the washing machine appliance shown in an open position.

FIGS. 1 and 2 illustrate an exemplary embodiment of a vertical axis washing machine appliance 100. In FIG. 1, a lid or door 130 is shown in a closed position. In FIG. 2, door 130 is shown in an open position. While described in the context of a specific embodiment of vertical axis washing machine appliance 100, it will be understood that vertical axis washing machine appliance 100 is provided by way of example only. Other washing machine appliances having different configurations, different appearances, and/or different features may also be utilized with the present subject matter as well, e.g., horizontal axis washing machines.

Washing machine appliance 100 has a cabinet 102 that defines a lateral direction L, a transverse direction T, and a vertical direction V. The lateral direction L, transverse direction T, and vertical direction V are mutually perpendicular and define an orthogonal coordinate system. As shown, cabinet 102 extends between a top 103 and a bottom 104 along the vertical direction V and between a front 106 and a back 107 along the transverse direction T. A wash basket 120 (FIG. 2) is rotatably mounted within cabinet 102. For example, a wash tub 124 (FIG. 3) may be mounted within the cabinet 102, as described in more detail below, and the wash basket 120 may be rotatably mounted within the wash tub 124. A motor (not shown) is in mechanical communication with wash basket 120 in order to selectively rotate wash basket 120 (e.g., during an agitation or a rinse cycle of washing machine appliance 100). Wash basket 120 defines a wash chamber 121 (FIG. 2) that is configured for receipt of articles for washing. An agitator or impeller extends from wash basket 120 into wash chamber 121 to assist agitation of articles disposed within wash chamber 121 during operation of washing machine appliance 100.

Cabinet 102 of washing machine appliance 100 has a top panel 200. Top panel 200 defines an aperture 105 (FIG. 2) that permits user access to wash chamber 121 of wash basket 120. Door 130 is rotatably mounted to top panel 200. However, alternatively, door 130 may be mounted to cabinet 102 or any outer suitable support. Door 130 selectively rotates between the closed position shown in FIG. 1 and the open position shown in FIG. 2. In the closed position, door 130 inhibits access to wash chamber 121. Conversely, in the open position, a user can reach through the aperture 105 to access wash chamber 121. A window 136 in door 130 permits viewing of wash chamber 121 when door 130 is in the closed position, e.g., during operation of washing machine appliance 100. Door 130 also includes a handle 132 that, e.g., a user may pull and/or lift when opening and closing door 130. Top panel 200 also defines at least one hole or opening 201 (FIG. 2) proximate the aperture 105. As described in more detail below, a hose may extend through the opening 201 in the top panel 200.

A control panel 110 with a plurality of input selectors 112 (FIG. 1) extends from top panel 200. Control panel 110 and input selectors 112 collectively form a user interface input for operator selection of machine cycles and features. A display 114 of control panel 110 indicates selected features, a countdown timer, and/or other items of interest to appliance users.

Various sensors may additionally be included in the washing machine appliance 100. For example, a pressure sensor (not shown) may be positioned in the tub 124. Any suitable pressure sensor, such as an electronic sensor, a manometer, or another suitable gauge or sensor, may be utilized. The pressure sensor may generally measure the pressure of water in the tub 124. This pressure can then be utilized to estimate the height or level of water in the tub 124. Additionally, a suitable speed sensor (not shown) can be provided to measure rotational speed of basket 120. Other suitable sensors, such as temperature sensors, etc., may additionally be provided in the washing machine appliance 100.

Operation of washing machine appliance 100 is controlled by a controller or processing device 150 that is operatively coupled to control panel 110 for user manipulation to select washing machine cycles and features. In response to user manipulation of control panel 110 the controller 150 operates the various components of washing machine appliance 100 to execute selected machine cycles and features. For example, the controller 150 may be in communication with (e.g., electrically coupled to) the input selectors 112 for user manipulation to select washing machine cycles and features. As illustrated, the input selectors 112 may be knobs or dials. In various embodiments, the input selectors 112 may include one or more user input devices, such as switches, buttons, touchscreen interfaces, etc., as well as or instead of the illustrated example input selectors 112. Appliance controller 150 may further be in communication with (e.g., electrically coupled to) various other components of appliance 100, such as one or more valves, one or more suitable sensors, etc.

Appliance controller 150 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, appliance controller 150 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 110 and other components of washing machine appliance 100, such as the door 130, and various valves, sensors, etc. may be in communication with appliance controller 150 via one or more signal lines or shared communication busses. It should be noted that controllers 150 as disclosed herein are capable of and may be operable to perform any methods and associated method steps as disclosed herein. For example, in some embodiments, methods disclosed herein may be embodied in programming instructions stored in the memory and executed by the controller 150.

In an illustrative embodiment, laundry items may be loaded into wash chamber 121 through aperture 105, and washing operation may be initiated through operator manipulation of input selectors 112. Wash basket 120 (and/or wash tub 124 shown in FIG. 3) may be filled with water and detergent to form a wash fluid. One or more valves, e.g., valves 78 and 80, can be controlled by controller 150 to provide for filling wash basket 120 to the appropriate level for the amount of articles being washed. Once wash basket 120 is properly filled with fluid, the contents of wash chamber 121 are agitated for cleansing of laundry items in wash basket 120.

After the agitation phase of the wash cycle is completed, wash basket 120 may be drained. Laundry articles can then be rinsed by again adding fluid to wash basket 120, depending on the particulars of the cleaning cycle selected by a user, impeller may again provide agitation within wash chamber 121. One or more spin cycles may also be used. In particular, a spin cycle may be applied after the wash cycle and/or after the rinse cycle in order to wring wash fluid from the articles being washed. During a spin cycle, wash basket 120 is rotated at relatively high speeds. After articles disposed in wash basket 120 are cleaned and/or washed, the user can remove the articles from wash basket 120, e.g., by reaching into wash chamber 121 through aperture 105.

Wash tub 124 is configured for containing fluid, e.g., wash and rinse fluids, during operation of washing machine appliance 100 described above. Wash and rinse fluids disposed within wash tub 124 can be used to clean articles disposed in wash basket 120. Wash and rinse fluids can pass between wash basket 120 and wash tub 124 through a plurality of apertures defined by wash basket 120, e.g., during the wash and/or spin cycles described above.

Various valves may regulate the flow of fluid into and through washing machine appliance 100 from water sources 76 and 77, e.g., water source 76 may include one or more fluid lines, pipes, conduits, etc. which provide hot water to washing machine appliance 100, e.g., from a residential water heater (not shown) and water source 77 may include one or more fluid lines, pipes, conduits, etc. which provide cold water to washing machine appliance 100. For example, as shown in FIG. 3, a hot water valve 78 and a cold water valve 80 may be positioned in such fluid lines to flow hot water and cold water, respectively, to washing machine appliance 100.

Each valve 78, 80 may be selectively adjusted between an open position allowing a flow of fluid therethrough and a closed position terminating or obstructing the flow of fluid therethrough. Hot water valve 78 may be in fluid communication with hot water source 76, which may be external to the washing machine appliance 100. Similarly, cold water valve 80 may be in fluid communication with cold water source 77, which may also be external to the washing machine appliance 100. The cold water source 77 may, for example, be a commercial water supply, while the hot water source 76 may be, for example, a water heater appliance.

Figure 3:
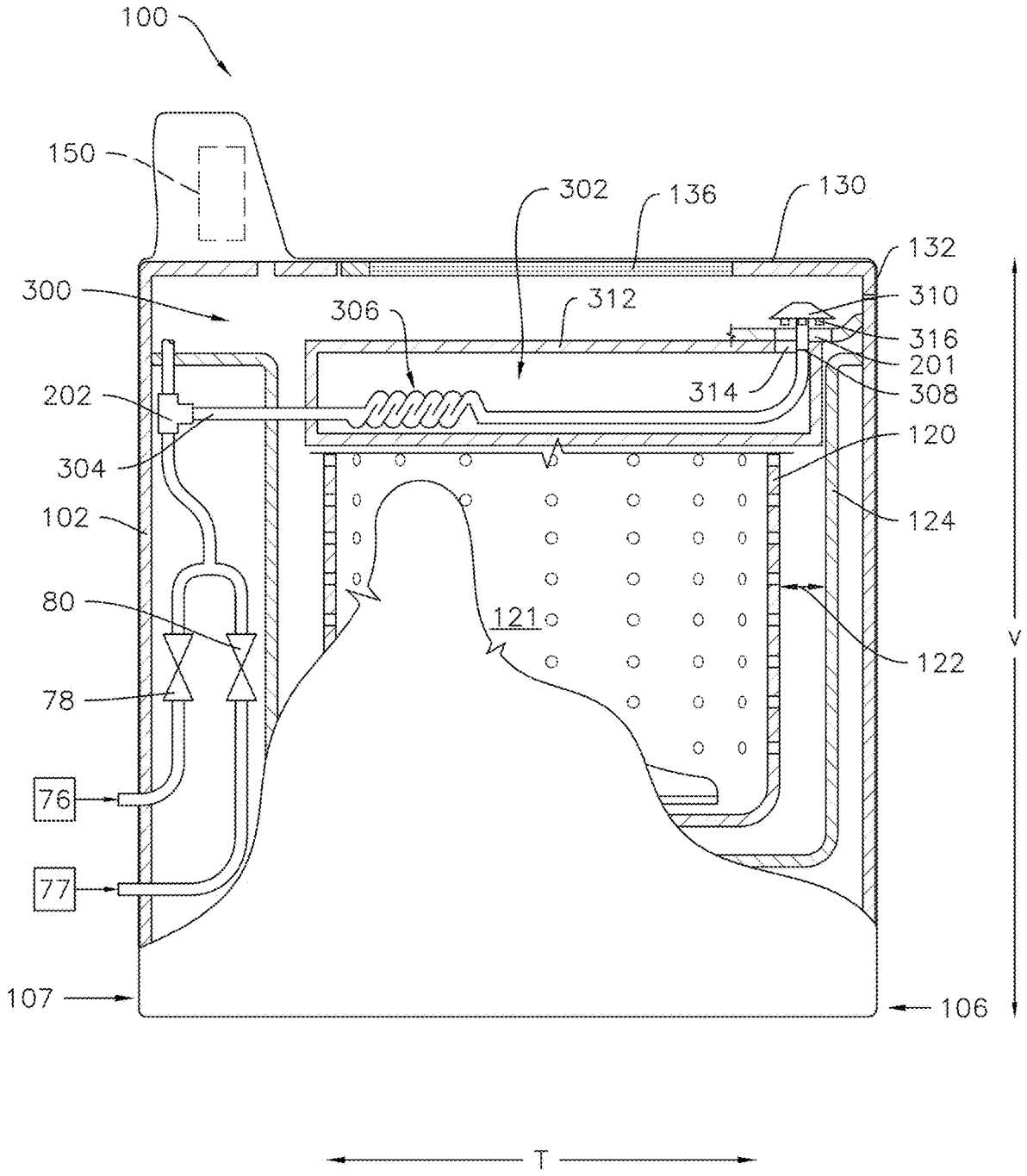
FIG. 3 provides a side cutaway view of the exemplary washing machine appliance of FIG. 1 including a retractable spray hose assembly according to one or more exemplary embodiments of the present subject matter.

As illustrated for example in FIG. 3, washing machine appliance 100 further includes a spray hose assembly 300 fluidly connected to a wash fluid source, e.g., one or more of the water sources 76, 77 and configured for selectively providing a flow of wash fluid in a desired direction and location. More particularly, for the embodiment depicted, spray hose assembly 300 is fluidly connected to a three-way valve 202. In the illustrated example, the valve 202 is positioned within cabinet 102, however, in various other embodiments, the valve 202 may also be positioned within or proximate to the control panel 110 or external to the cabinet 102. Three-way valve 202 is depicted as a T-valve downstream of valves 78, 80. However, in other exemplary embodiments, any suitable three-way valve 202 may be utilized, and further, three-way valve 202 may be attached in any suitable location. For example, in other embodiments, three-way valve 202 may be a Y-valve, and/or may be upstream of valves 78, 80. In the latter embodiment, washing machine appliance 100 may further include two three-way valves, such that a first three-way valve is upstream of hot water valve 78, and a second three-way valve is upstream of cold water valve 80. By being positioned upstream of valves 78, 80, spray hose assembly 300 may provide a flow of water independently from a flow of water provided to other parts of the washing machine appliance 100 (i.e., independently of whether or not valves 78, 80 are open or closed). Alternatively, a single three-way valve may be provided upstream of either hot water valve 78 or cold water valve 80. Notably, in such an embodiment, a spray hose assembly 300 may only provide hot water or cold water, respectively.

Spray hose assembly 300 includes a retractable hose 302 and a spray head 310 attached to the retractable hose 302. Spray hose assembly 300 is generally configured for providing a flow of wash fluid, e.g., water, into wash tub 124. More specifically, the flow of wash fluid is provided through semi-rigid or flexible hose 302. Retractable hose 302 is generally any fluid conduit that extends from a fluid supply to a location suitable for discharging wash fluid into wash tub 124. In this regard, for example, retractable hose 302 may include an inlet 304 and an outlet 308. Inlet 304 is fluidly connected to three-way valve 202 for receiving a flow of wash fluid. Although retractable hose 302 is illustrated as being coupled to three-way valve 202, it should be appreciated that retractable hose 302 could instead be connected to a detergent box, a wash additive reservoir, a hot or cold water supply, or any other suitable wash fluid supply source. According to an exemplary embodiment, retractable hose 302 may be constructed from any suitably flexible conduit, such as vinyl or rubber. In addition, as used herein, "wash fluid" may refer to water, including liquid water and/or steam, as well as detergent, fabric softener, bleach, or any other suitable wash additive or combination thereof.

According to the illustrated embodiment, e.g., as shown in FIG. 3, spray head 310 is attached to the outlet 308 of retractable hose 302. Spray head 310 is generally configured for directing the flow of wash fluid in the desired direction, generating the desired spray pattern, or otherwise controlling the flow of wash fluid. For example spray head 310 may include a plurality of outlets 316 through which a wash fluid, e.g., water, may be sprayed for directing the flow of wash fluid to desired locations, e.g., in the tub 124. In various embodiments, outlets 316 may, for example, be tubes extending from the spray head 310, or alternatively may simply be holes or apertures defined in the spray head 310. However, in other embodiments, outlets 316 may be nozzles or any other suitable openings through which wash fluid may be sprayed. Further, spray head 310 may additionally include other openings, holes, etc. (not shown) through which wash fluid may be flowed, i.e., sprayed or poured, into the tub 124 and/or basket 120.

Figure 4:
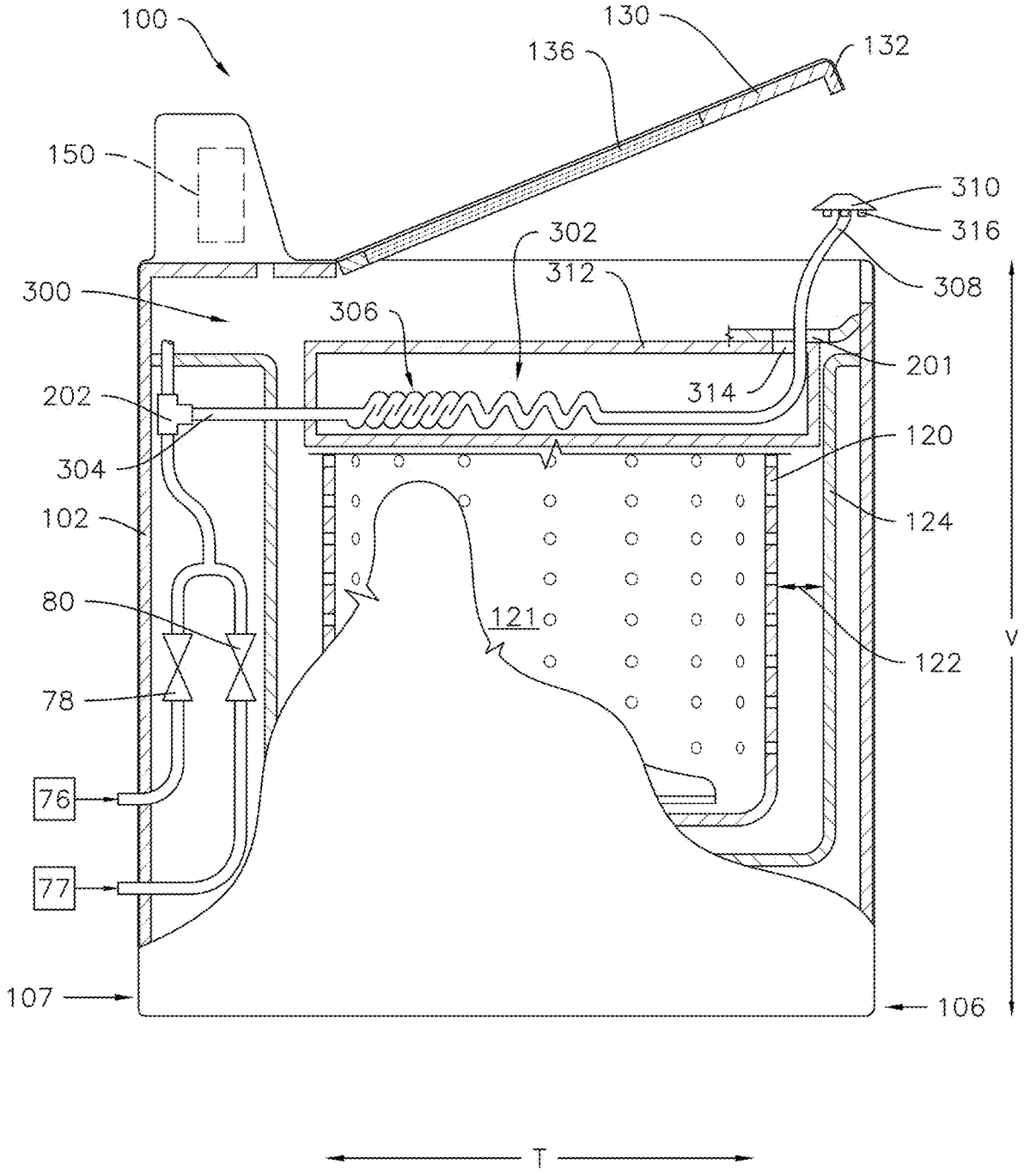
FIG. 4 provides a view of the exemplary washing machine appliance of FIG. 3 with the retractable spray hose assembly in an extended position.

The retractable hose 302 may be mounted within the cabinet 12. For example, in some embodiments, such as is illustrated in FIGS. 3 and 4, the retractable hose 302 may be at least partially positioned within a housing 312 and the housing 312 may be mounted within the cabinet 12, e.g., below the top panel 200 along the vertical direction V. For example, the housing 312 may be mounted directly below and in direct contact with the top panel 200, as illustrated in FIGS. 3 and 4. In other embodiments, the housing 312 may be mounted below and proximate to the top panel 200. In particular, the housing 312 may include an aperture 314 and the aperture 314 may be aligned with the opening 201 in the top panel 200. Accordingly, in some embodiments, the retractable hose 302 may extend through the aperture 314 in the housing 312 and the opening 201 in the top panel 200. The retractable hose 302 is at least partially disposed within the cabinet 12. For example, FIG. 3 illustrates a retracted position of the spray hose assembly 300, wherein the retractable hose 302 is predominantly disposed within the housing 312 and within the cabinet 12, with the outlet 308 and a minor portion of the retractable hose 302 extending out of the housing 312 and cabinet 12 and, e.g., through the aperture 314 of the housing 312 and through the opening 210 in the top panel 200, to connect to the spray head 310.

FIG. 4 illustrates an example extended position of the spray hose assembly 300, wherein the retractable hose 302 is partially disposed within the housing 312 and within the cabinet 12, with the outlet 308 and a downstream portion of the retractable hose 302 extending through the aperture 314 of the housing 312 and through the opening 210 in the top panel 200. When the spray hose assembly 300 is extended, e.g., as shown in FIG. 4, the spray head 310 may be freely moved with respect to the cabinet 12 and wash tub 124 to selectively provide a flow of wash fluid through the hose 302 and from the spray head 310 in a desired direction and location.

Figure 5:
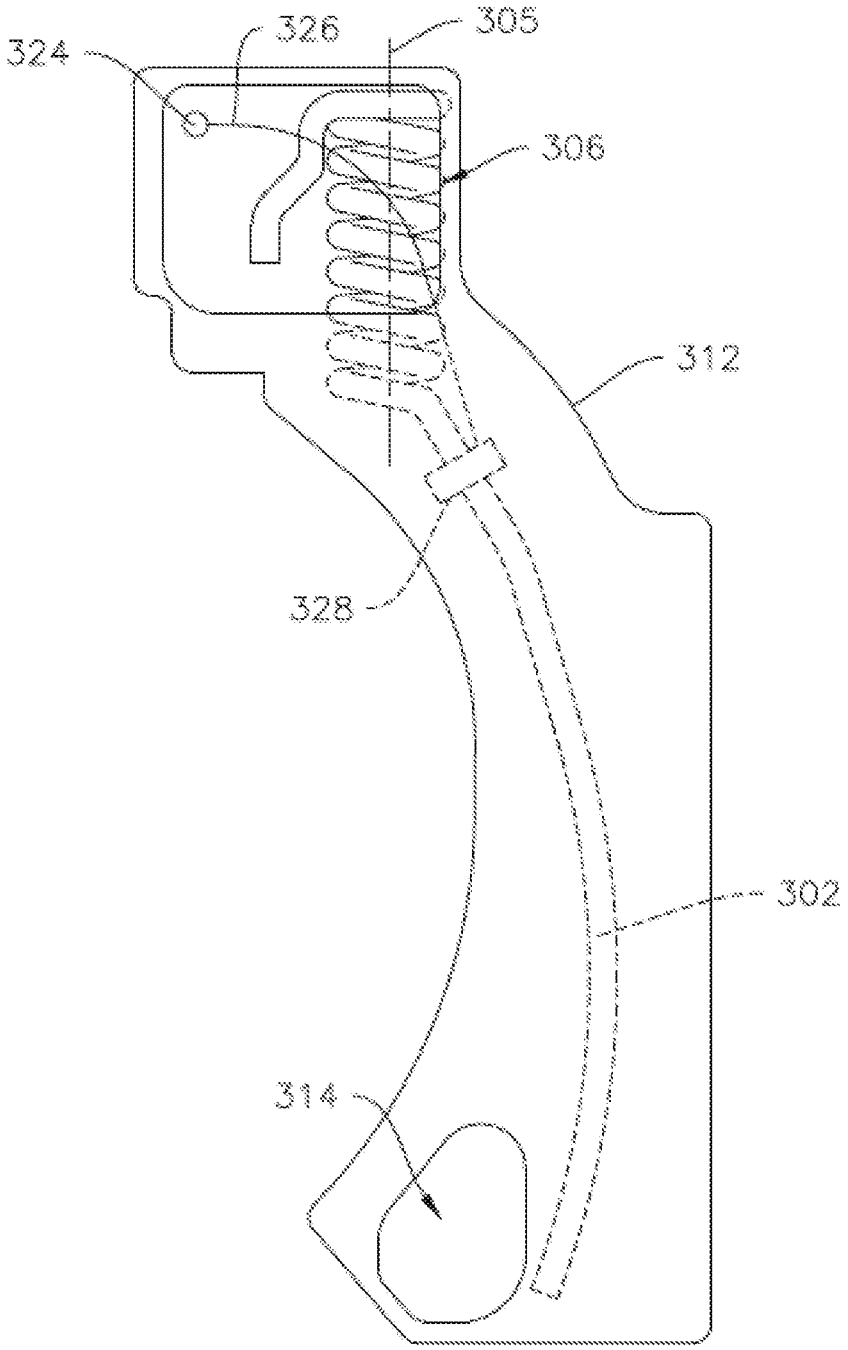
FIG. 5 provides a top view of an exemplary hosing and spray hose assembly according to one or more exemplary embodiments of the present subject matter.
Figure 6:
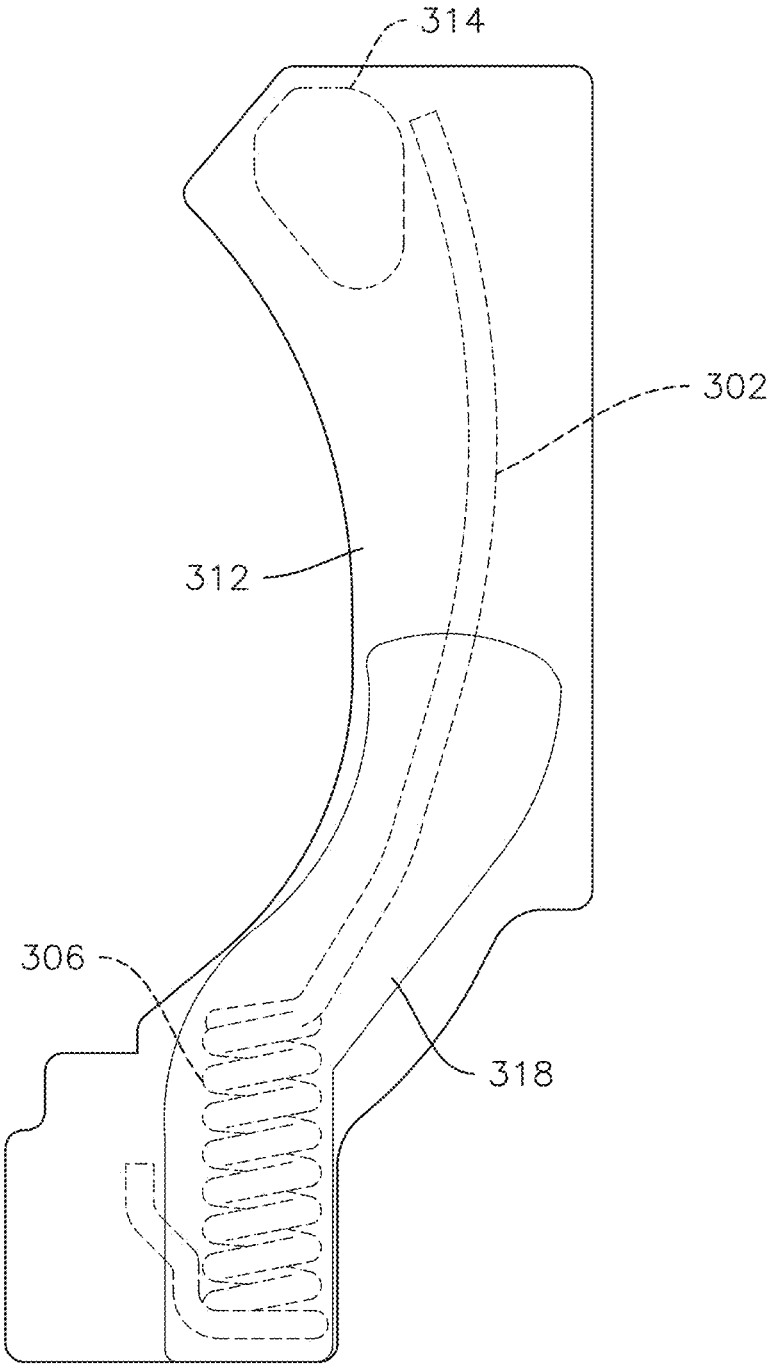
FIG. 6 provides a bottom view of the exemplary hosing and spray hose assembly of FIG. 5.

As best seen in FIGS. 5 and 6, in various embodiments, the retractable hose 302 may include a coiled section 306. In some embodiments wherein the retractable hose 302 is at least partially disposed within the housing 312, the coiled section 306 of the retractable hose 302 may be positioned within a rounded portion 318 (FIG. 6) of the housing 312. When the retractable hose 302 is extended outside the housing 312 and/or cabinet 12, e.g., by a user grasping and pulling on the spray head 310, one or more loops of the coiled section 306 may uncoil to permit such extension (FIG. 4). As mentioned above, the retractable hose 302 may comprise a flexible, elastic material such as rubber. Accordingly, when the extending force on the retractable hose 302 is removed, e.g., when the user releases the spray head 310, the retractable hose 302 may automatically retract as the coiled section 306 returns to its resting, fully coiled state, e.g., the position illustrated in FIGS. 3, 5, and 6. The shape of the rounded portion 318 may advantageously permit the coiled section 306 to expand and contract as described. For example, the rounded portion 318 may guide movement of the coiled section 306 when the retractable hose 302 extends and retracts.

As shown in FIG. 5, the coiled section 306 of the retractable hose 302 defines a central axis 305. For example, the coiled section 306 may define a helical shape, with turns of the helix centered about the central axis 305. In various embodiments, the retractable hose 302 may be horizontally oriented within the cabinet 12 such that the central axis 305 of the retractable hose 302 is oriented, e.g., generally along one of the lateral direction L or the transverse direction T, or otherwise in a lateral-transverse plane defined by the lateral direction L and the transverse direction T. For example, the retractable hose 302 may extend between the front 106 and the back 107 of the cabinet 12 such that the central axis 305 of the coiled section 306 is oriented generally along the transverse direction T. As used herein, terms of approximation, such as "generally," or "about" include values within ten percent greater or less than the stated value. When used in the context of an angle or direction, such terms include within ten degrees greater or less than the stated angle or direction. For example, the central axis 305 of the coiled section 306 may be oriented generally along the transverse direction T when the central axis 305 of the coiled section 306 forms an angle of up to 10° in any direction, e.g., clockwise or counterclockwise, relative to the transverse direction T.

Figure 7:
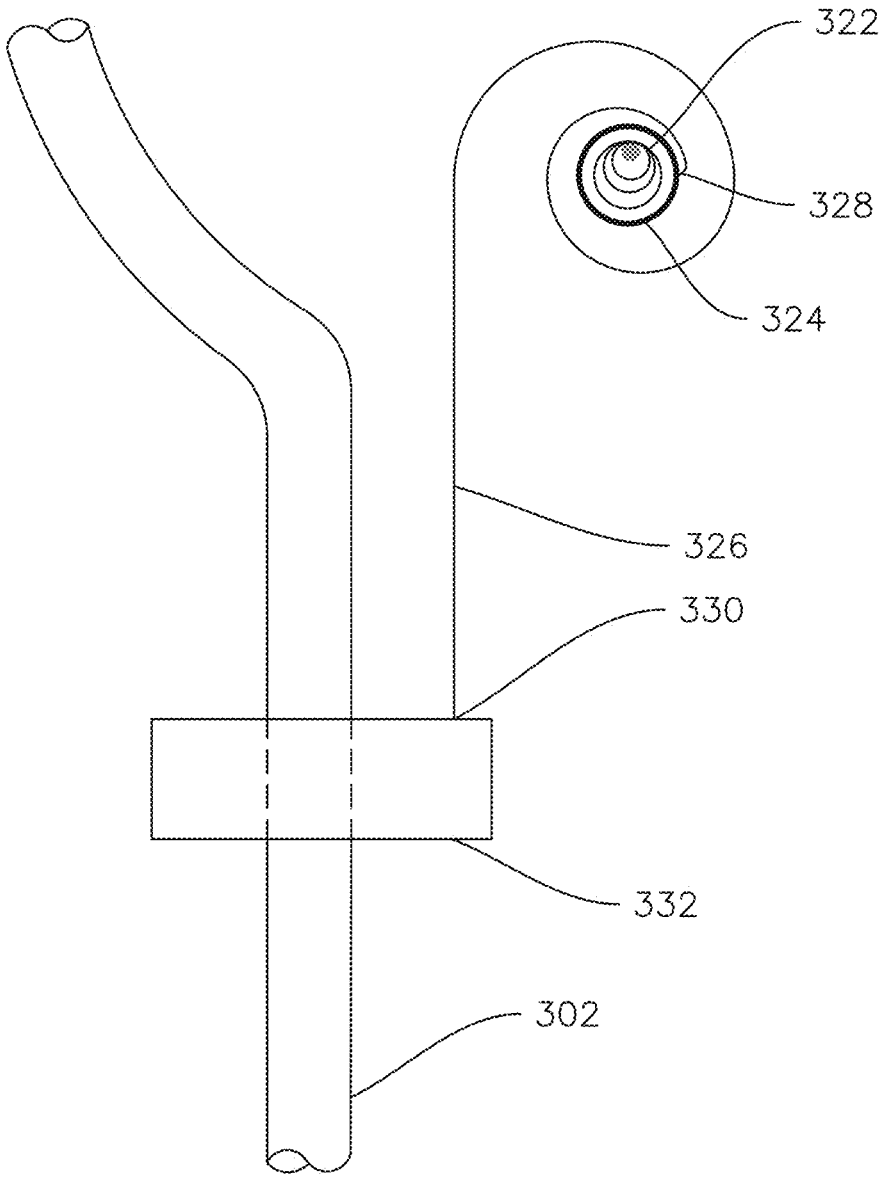
FIG. 7 provides an enlarged partial view of a retractable hose and a retraction mechanism according to one or more exemplary embodiments of the present subject matter.

As may be seen in FIGS. 5 and 7, the spray hose assembly 300 may also or instead include an external retraction mechanism to aid in retracting the hose 302, either separately from or in combination with the coiled section 306. For example, one embodiment of an external retraction mechanism may include a torsion spring 322 (FIG. 7) connected to the retractable hose 302 and configured to provide an angular return force to the retractable hose 302 when the retractable hose 302 is extended out of the cabinet 12. As described in more detail herein, the torsion spring 322 may bias the retractable hose 302 towards the retracted position. In the illustrated example of FIG. 7, the torsion spring 322 is provided as a flat spiral spring. However, one of ordinary skill in the art will understand that any suitable torsion spring 322 may be provided. As seen in FIGS. 5 and 7, the spray hose assembly 300 may include a reel 324 positioned within and rotatably mounted to the housing 312 and a wire 326 which may be partially wound around the rotatable reel 324 and connected to the reel 324 at a first end 328 of the wire 326 and connected to the retractable hose 302 at a second end 330 of the wire 326. For example, the second end 330 of the wire 326 may be connected to the retractable hose 302 by a collar 332 encircling a portion of the retractable hose 302. The torsion spring 322 may be coupled to the rotatable reel 324 such that the torsion spring 322 operatively engages the reel 324. Accordingly, when the retractable hose 302 is extended out of the housing 312 and/or cabinet 12, the reel 324 rotates and the wire 326 unspools from the reel 324, thereby tensioning the torsion spring 322. Thus, when the extending force is removed, the torsion spring 322 will provide the angular return force to the retractable hose 302. For example, in the illustrated embodiment, the torsion spring 322 provides the angular return force to the retractable hose 302 via the reel 324, the wire 326, and the collar 332.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance defining a vertical direction, a lateral direction, and a transverse direction, the vertical direction, the lateral direction and the transverse direction are mutually perpendicular, the washing machine appliance comprising:

a cabinet extending between a top and a bottom along the vertical direction;

a wash tub mounted within the cabinet and configured for containing fluid during operation of the washing machine appliance; and a spray hose assembly fluidly connected to a wash fluid source and configured for selectively providing a flow of wash fluid in a desired direction and location, the spray hose assembly comprising:

a retractable hose comprising a coiled section mounted within the cabinet;

a spray head attached to the retractable hose;

a torsion spring connected to the retractable hose, the torsion spring configured to provide an angular return force to the retractable hose when the retractable hose is extended out of the cabinet;

a reel, the torsion spring operatively engaging the reel; and a wire connected at a first end of the wire to the reel and connected at a second end of the wire to a collar, the collar encircling a portion of the retractable hose, wherein the torsion spring is configured to provide the angular return force to the retractable hose via the reel, the wire, and the collar.

2. The washing machine appliance of claim 1, further comprising a top panel positioned at the top of the cabinet and a housing mounted below the top panel of the cabinet, the retractable hose positioned within the housing.

3. The washing machine appliance of claim 1, wherein the coiled section of the retractable hose defines a central axis and the central axis of the coiled section is oriented generally along the transverse direction.

4. The washing machine appliance of claim 1, further comprising a top panel positioned at the top of the cabinet and a housing mounted below the top panel of the cabinet, wherein the housing comprises a rounded portion and the coiled section of the retractable hose is positioned within the rounded portion of the housing.

5. The washing machine appliance of claim 1, further comprising a top panel positioned at the top of the cabinet and a housing mounted below the top panel of the cabinet, the reel mounted to the housing within the housing.

6. The washing machine appliance of claim 5, wherein the housing comprises a rounded portion and the coiled section of the retractable hose is positioned within the rounded portion of the housing.

7. A washing machine appliance comprising:

a cabinet;

a wash tub mounted within the cabinet and configured for containing fluid during operation of the washing machine appliance;

an aperture defined in the cabinet, the wash tub aligned with the aperture whereby the aperture provides access to the wash tub;

a door mounted to the cabinet, the door adjustable between an open position permitting access to the wash tub via the aperture and a closed position, wherein the door encloses the aperture in the closed position; and a spray hose assembly fluidly connected to a wash fluid source and configured for selectively providing a flow of wash fluid in a desired direction and location, the spray hose assembly including a retractable hose partially disposed within the cabinet, a reel, a torsion spring connected to the retractable hose and operatively engaging the reel, a wire connected at a first end of the wire to the reel and connected at a second end of the wire to a collar, the collar encircling a portion of the retractable hose, the torsion spring configured to provide an angular return force to the retractable hose biasing the retractable hose into the cabinet via the reel, the wire, and the collar, and a spray head attached to the retractable hose, the retractable hose extending through an opening in the cabinet proximate the aperture.

8. The washing machine appliance of claim 7, further comprising a top panel positioned at a top of the cabinet and a housing positioned below the top panel of the cabinet, wherein the retractable hose is partially disposed within the housing.

9. The washing machine appliance of claim 8, wherein the housing comprises an aperture, the retractable hose extends through the aperture in the housing, and the aperture in the housing is aligned with the opening in the cabinet.

10. The washing machine appliance of claim 7, wherein the retractable hose comprises a coiled section.

11. The washing machine appliance of claim 10, further comprising a top panel positioned at a top of the cabinet and a housing mounted below the top panel of the cabinet, wherein the housing comprises a rounded portion and the coiled section of the retractable hose is positioned within the rounded portion of the housing.

12. The washing machine appliance of claim 7, further comprising a top panel positioned at the top of the cabinet and a housing mounted below the top panel of the cabinet, the reel mounted to the housing within the housing.

13. The washing machine appliance of claim 12, wherein the retractable hose comprises a coiled section.

14. The washing machine appliance of claim 13, wherein the housing comprises a rounded portion and the coiled section of the retractable hose is positioned within the rounded portion of the housing.

* * * * *